United States Patent [19]

Silay et al.

[11] Patent Number: 4,588,231

[45] Date of Patent: May 13, 1986

[54] PAVEMENT SURFACING MACHINE

[75] Inventors: Louis E. Silay; James S. Stein; John J. Kunzweiler, all of Sonora, Calif.

[73] Assignee: Concrete Safety Equipment, Inc., Torrance, Calif.

[21] Appl. No.: 645,022

[22] Filed: Aug. 28, 1984

Related U.S. Application Data

[63] Continuation of Ser. No. 343,308, Jan. 27, 1982, abandoned.

[51] Int. Cl.[4] ..... E21C 47/00

[52] U.S. Cl. ..... 299/39; 404/90

[58] Field of Search ..... 299/36, 39, 40, 41; 404/90, 91, 92; 51/176; 180/15

[56] References Cited

U.S. PATENT DOCUMENTS

| | | | |
|---|---|---|---|
| 811,403 | 1/1906 | Inglis | 180/15 |
| 1,972,839 | 9/1934 | DeGraw | 180/15 |
| 3,333,897 | 8/1967 | Rhodes | 299/39 |
| 3,407,005 | 10/1968 | Simms et al. | 299/39 |
| 3,606,468 | 9/1971 | Walker et al. | 299/39 |
| 3,703,316 | 11/1972 | Hatcher et al. | 299/39 |
| 3,770,071 | 11/1973 | Opel | 180/15 |
| 3,779,606 | 12/1973 | Hatcher et al. | 299/39 |
| 3,989,304 | 11/1976 | Wirtgen | 299/39 |

*Primary Examiner*—Stephen J. Novosad
*Assistant Examiner*—John F. Letchford
*Attorney, Agent, or Firm*—Nilsson, Robbins, Dalgarn, Berliner, Carson & Wurst

[57] ABSTRACT

Road or pavement surfacing machine which is towed to and from a work site by a truck tractor or the like and is self-propelled by power driven traction wheels on the machine during road or pavement surfacing operation. The traction wheels and the road or pavement surfacing cutter means of the machine are independently vertically adjustable relative to the main load supporting wheels of the machine, and hence relative to one another, by hydraulic actuator means for the cutter means and additional hydraulic actuator means for the traction wheels. These actuator means are independently operable to elevate the traction wheels and surfacing means out of contact with the road during transit of the machine from one location to another, to individually adjust and preset the contact pressure of the traction wheels and surfacing means with the road or pavement being surfaced, and to maintain the preset contact pressures, thereby to maintain the surfacing cutter means in proper cutting contact and the traction wheels in driving contact with the road. The preferred road surfacing machine of the invention has a water tank which contains cooling, flushing and lubricating water for the road surfacing means and whose weight is reacted downwardly on both the traction wheels and surfacing means to increase their contact pressure with the road being surfaced.

12 Claims, 8 Drawing Figures

PAVEMENT SURFACING MACHINE

This is a continuation of co-pending application Ser. No. 343,308, filed Jan. 27, 1982, now abandoned.

BACKGROUND OF THE INVENTION

1. Field of the Invention

This invention relates generally to road working or repair equipment and more particularly to a novel self-propelled road or pavement surfacing machine.

2. Prior Art

The road or pavement surfacing machine of the invention, hereinafter referred to simply as a road surfacing machine, is intended primarily for cutting or grinding concrete pavement to remove ruts, bumps, steps, and the like, and/or to cut anti-skid grooves into the pavement surface. For this reason, the invention will be described in this context.

Concrete roads or pavements are often resurfaced to restore pavements which have become degraded by extended usage, especially truck usage. Such degradation may take the form of ruts or the like which are worn into the pavement surface, undulations produced by bouncing of heavy vehicles, and steps resulting from relative vertical displacement or faulting of adjacent pavement slabs along their transverse joints. Pavement resurfacing may also involve cutting anti-skid grooves into the pavement surface.

At one time, the only way of resurfacing degraded pavements was to apply an overlay to the pavement surface. This overlay procedure, however, is time consuming, costly and causes extended interference with traffic. Pavement grooving was generally impractical.

For these reasons, machines were devised for resurfacing pavements by cutting or grinding the pavement surface. These road or pavement surfacing machines are designed to remove ruts, undulations, steps, and the like from a pavement by cutting or grinding the pavement surface and to cut anti-skid grooves into the surface. Examples of such machines are described in the following patents: U.S. Pat. Nos. 3,037,755; 3,409,330; 3,697,135; and 3,703,316.

One of the problems associated with such road surfacing machines involves their transportation to and from a work site and their propulsion during actual road surfacing operation. Thus, such a machine must be capable of transit to and from a work site along normal streets and highways and in normal street and highway traffic. On the other hand, the primary machine requirement for road surfacing operation is extremely high traction power at low speed.

Another problem associated with road surfacing machines of the class described is attaining adequate loading on the road surfacing means to achieve effective pavement surfacing action without excessive degradation of the cutters. Inadequate loading of pavement surfacing cutters, for example, allows the cutters to ride up or over the pavement which tends to glaze the cutters and create an uneven pavement surface. In the past, this problem was alleviated to some degree by using specially designed cutters for different pavement materials. This solution has not been satisfactory, however, owing to the difficulty and cost of providing and maintaining the required range of cutters and the difficulty of providing optimum cutter designs for all work conditions and pavement materials.

For this reason, ways were sought to increase the loading on the road surfacing cutters in order to force the latter to cut through rather than ride up or over the pavement. In some road surfacing machines this increase in cutter loading is accomplished by reacting downwardly on the cutters a portion of the weight of a tank containing water which is used to cool, flush, and lubricate the road surfacing cutters. U.S. Pat. No. 3,703,316, for example, discloses a road surfacing machine of this type. Even with such increased loading, however, it happens very frequently that the cutting resistance of the pavement and forward speed of the surfacing machine are such that the cutters still ride up and over the pavement.

In addition to glazing the surfacing cutters and producing an uneven surface, this riding of the cutters up and over the pavement has another serious consequence in existing road surfacing machines because of the manner in which their traction wheels are mounted. Thus, in the existing machines, when the cutting resistance of the pavement and forward speed of the surfacing machines are such that the pavement lifts the cutters up and over the pavement, there is exerted on the machines an upward force which opposes and reduces the contact pressure of their traction wheels with the pavement. This causes the traction wheels to spin and creates a highly undesirable surface defect in the pavement.

SUMMARY OF THE INVENTION

This invention provides an improved road surfacing machine of the character described. According to one important feature of the invention, the improved machine is towed by another vehicle, such as a truck tractor, to and from the work site and is self-propelled during actual road surfacing operation. The machine has main load bearing wheels which provide the sole support for the machine during its transit to and from a work site and provide the primary support for the machine during its road surfacing operation. The road surfacing means of the machine are cooled, flushed, and lubricated by water from a holding tank on the machine.

Another important feature of the present road surfacing machine is concerned with the unique arrangement of its propulsion system, whereby the machine is adapted to be self-propelled with high power and at slow speed during actual road surfacing operation and to be towed at reasonable traffic speeds to and from a work site without damage to the drive system of the machine. According to this feature, the road surfacing machine is equipped with traction wheels, separate from the main load bearing wheels of the machine, which are powered by an internal combustion engine on the machine through a drive system capable of delivering the required high driving torque at slow speeds to the traction wheels to propel the machine along the road being surfaced. These traction wheels, and the road surfacing means of the machine, are arranged to be raised out of contact with the road during towing of the machine from one location to another in order to avoid damage to the traction wheel drive system and the road surfacing means.

Yet another important feature of the present road surfacing machine is concerned with adjustable loading of its traction wheels and road surfacing means to maintain optimum contact pressure of each with the road surface and thereby condition the machine for more effective road surfacing action. According to this feature of the invention, the traction wheels and road surfacing means are individually vertically adjustable relative to the main load bearing wheels of the machine by separate hydraulic actuators in a manner which permits individual adjustment of the contact pressure of the traction wheels and the road surfacing means with the road being surfaced. These hydraulic actuators maintain the road surfacing means in contact with the road with sufficient contact pressure to normally cut through rather than ride up or over the road surface and maintain the traction wheels in sufficient driving contact with the road to drive the surfacing machine without slipping of the wheels even when the cutting resistance of the pavement becomes sufficient to lift the cutters and thereby tend to reduce the contact pressure of the traction wheels with the road.

DESCRIPTION OF THE PREFERRED EMBODIMENT

Figure 1:
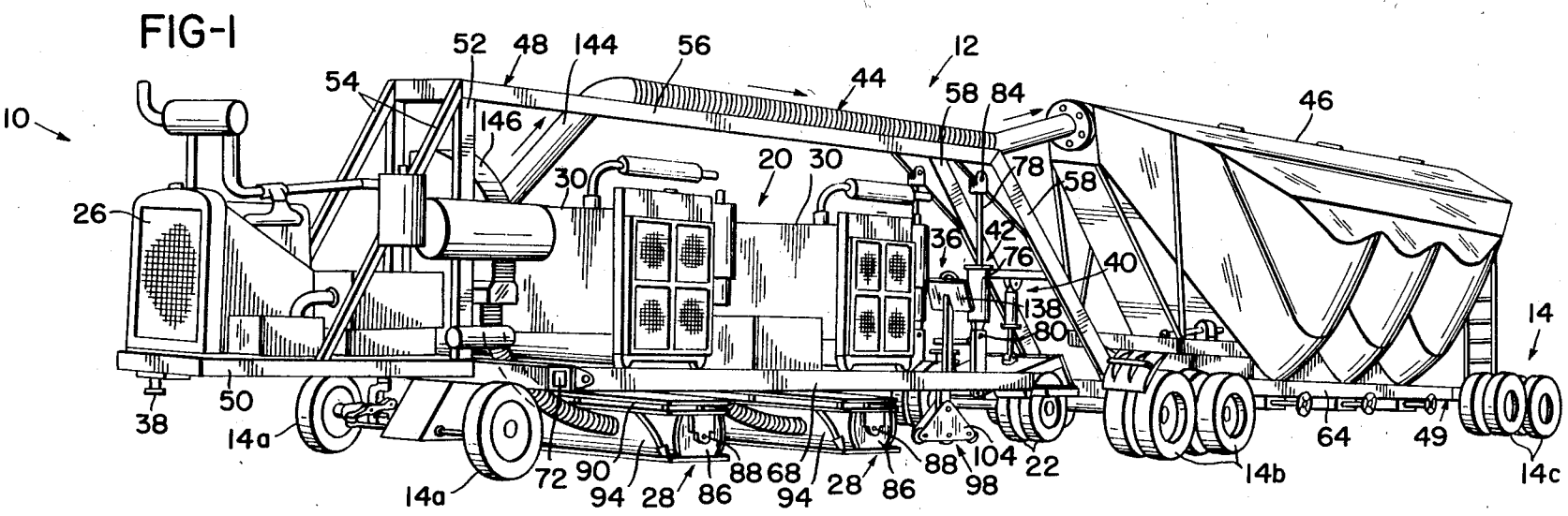
FIG. 1 is a perspective view of an improved road surfacing machine according to the invention.
Figure 2:
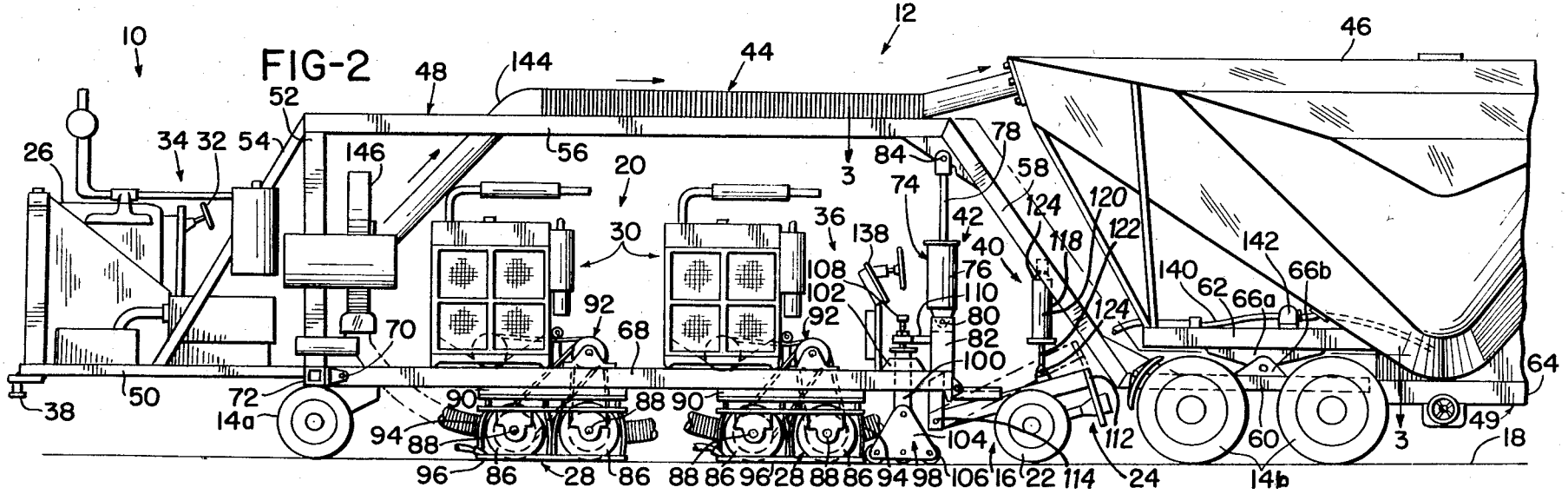
FIG. 2 is a fragmentary side elevation of the machine.
Figure 3:
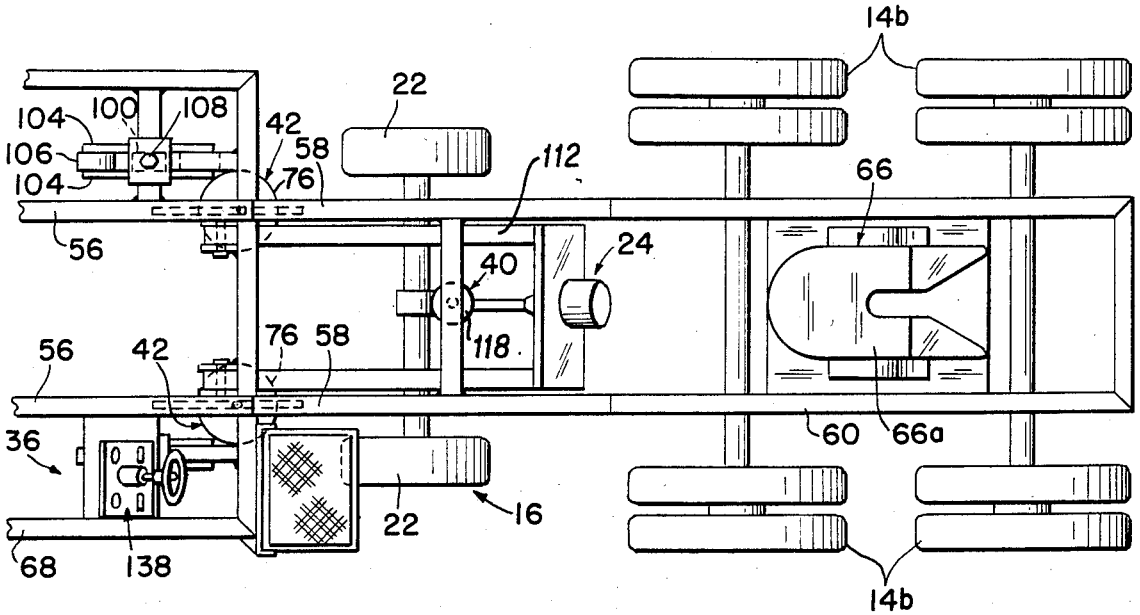
FIG. 3 is an enlarged sectional view taken substantially along line 3—3 in FIG. 2.
Figure 4:
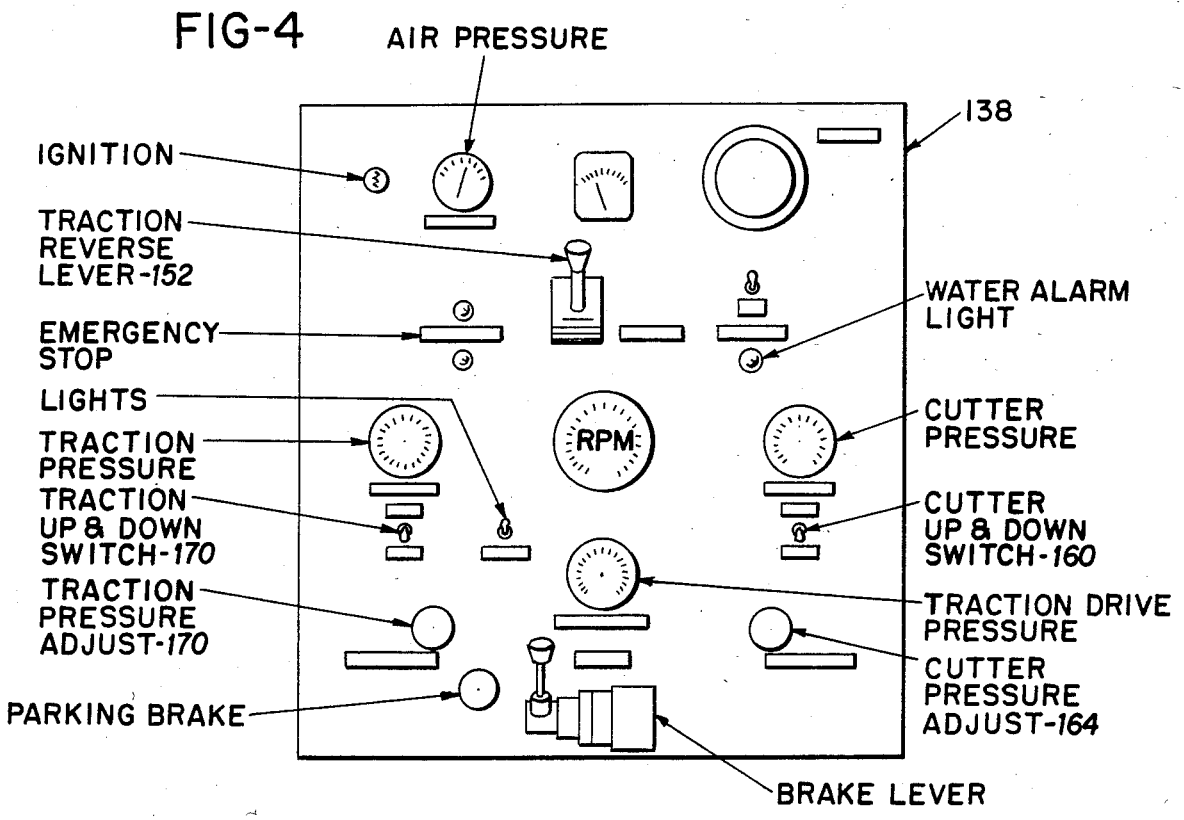
FIG. 4 is a face view of the control panel of the machine.

The illustrated road surfacing machine 10 of the invention comprises a vehicle 12 having main load bearing wheels 14, propulsion means 16 for propelling the vehicle along a road 18, such as a pavement, to be surfaced, and a road surfacing mechanism 20. The vehicle propulsion means 16 includes traction wheels 22 driven by drive means 24 powered by an internal combustion engine 26 on the front end of the vehicle. The road surfacing mechanism 20 includes road surfacing means 28 powered by internal combustion engines 30 on the machine for grinding, cutting, or otherwise surfacing the road 18.

The main load bearing wheels 14 of the machine include front steering wheels **14*a* operated by a steering wheel 32 through a hydraulic steering system for steering the vehicle 12 during its road surfacing operation. This steering wheel and controls for the vehicle propulsion means 16 are situated at a driver's station 34. As will be explained presently, other machine controls are located at a surfacing operation control station 36**.

According to one important feature of the invention, the road surfacing machine 10 is towed to and from a work site by a truck tractor (not shown) and is self-propelled during actual road surfacing operation. To these ends, the front end of the vehicle 12 mounts a coupling member 38 forwardly of its front steering wheels **14*a* for coupling the vehicle to a truck tractor (not shown). Actuator means 40 and 42 are provided for raising and lowering the vehicle traction wheels 22 and the road surfacing means 28, respectively, relative to the main vehicle load bearing wheels 14**.

When towing the road surfacing machine 10 from one location to another, its traction wheels 22 and road surfacing means 28 are raised clear of the ground. The front end of the machine is connected, by the coupling member 38, to a truck tractor capable of towing the machine along highways and city streets at acceptable speeds. During actual road surfacing operation, the traction wheels 22 and the road surfacing means 28 are lowered into contact with the road.

According to another important feature of the invention, the actuator means 40, 42 for raising and lowering the traction wheels 22 and road surfacing means 28 are independently operable to individually adjust and maintain the contact pressure of the traction wheels and road surfacing means with the road in such a way as to obtain the optimum contact pressure of each for the most effective road surfacing action. This requires, of course, sufficient contact pressure of the traction wheels with the road to minimize or avoid slipping of these wheels and proper contact pressure of the road surfacing means with the road to avoid glazing and/or other damage to the road surfacing means.

Related to this latter feature of the invention is the fact that the road surfacing machine 10 has a cooling, flushing, and lubricating system 44 for the road surfacing means 28. This system includes a water tank 46 on the vehicle 12 containing water which is sprayed onto the surfacing means during road surfacing operation to cool and lubricate and flush debris from the surfacing means. The traction wheel and surfacing actuators 40, 42 react weight of this tank on the traction wheels 22 and surfacing means 28 to obtain the proper loading thereon.

Referring now in more detail to the drawings, the road surfacing vehicle 12 has front and rear articulated frames 48, 49 supported on the main load bearing wheels 14. The front frame 48 includes a front horizontal platform-like frame section 50 which projects forwardly of the front vehicle steering wheels **14*a* a distance above the ground. Rigidly joined to the rear end of this front platform section and rising therefrom, directly over the front steering wheels 14*a*, is a front upstanding frame section 52. Diagonal braces 54 extend between the frame sections 50, 52, as shown. Rigidly joined to the upper end of and extending rearwardly from the front upstanding frame section 52 is a horizontal elevated frame section 56. A downwardly inclined frame section 58 is rigidly joined, at its upper end, to the rear end of the elevated frame section 56 and at its lower end to a rear horizontal frame section 60. This rear frame section 60 is supported on a set of tandem wheels 14*b* of the main vehicle load bearing wheels 14**.

The rear vehicle frame 49 includes front and rear horizontal frame sections 62, 64 which are rigidly joined to one another. The front frame section 62 is stepped upwardly relative to the rear frame section 64 and overlies the rear section 60 of the front vehicle frame 48. The rear frame section 64 of the rear vehicle frame 49 forms a bed on which is supported the water tank 46. The rear end of the rear frame section 64 is supported on a second set of tandem wheels **14*c* of the main vehicle load bearing wheels 14**.

The vehicle frames 48, 49 are supported on the load bearing wheels **14*a*, 14*b*, 14*c* by any suitable wheel suspension system. The rear section 60 of the front vehicle frame 48 is pivotally and releasably coupled to the overlying front section 62 of the rear vehicle frame 49 by a conventional truck tractor trailer coupling 66 including coupling parts 66***a* and 66*b* on these frame sections, respectively.

From the above description, it is evident that approximately one-half the weight of the water tank 46 and its frame 49 and other parts thereon is exerted downwardly on the rear end of the front vehicle frame 48.

As noted earlier, the road surfacing mechanism 20 of the road surfacing machine 10 comprises road surfacing means 28 driven by internal combustion engines 30. The road surfacing means 28 are capable of being raised and lowered relative to the main load bearing wheels 14 of the machine by the actuator means 42. The entire road surfacing mechanism, including its road surfacing means and driving engines, is supported on a platform-like frame structure 68 which is located directly below the elevated horizontal main frame section 56 at the approximate level of the front main frame section 50. The platform 68 is approximately coextensive with the elevated frame section 56. The front end of the surfacing platform 68 is pivotally attached at 70 to a cross beam 72 rigidly joined to the rear end of the front main frame section 50 and the lower end of the upright frame section 52. The platform is thus vertically swingable about the pivotal attachment 70.

The actuating means 42 for the road surfacing means 28 comprises a pair of hydraulic actuators 74, each including a lower cylinder 76 and an upper piston 78. The two actuators are located at opposite sides of the machine, over the rear end of the hinged platform 68. The lower ends of the actuator cylinders 76 are pivotally attached at 80 to uprights 82 rigidly joined to and rising from the rear end of the platform. The upper ends of the actuator plungers 78 are pivotally attached at 84 to the upper end of the inclined main frame section 58.

From this description, it will be understood that the hydraulic actuators 42 may be operated to raise and lower the hinged surfacing platform 68. The actuators are controlled from the control station 36, as will be explained presently.

The road surfacing means 28 are mounted on the underside of the hinged surfacing platform 68 in spaced relation along the platform. Their driving engines 30 are similarly mounted on the top of the platform almost over the road surfacing means, respectively. These road surfacing means are generally similar and conventional and each comprises pairs of road or pavement cutting or grinding rotors 86, hereinafter referred to simply as cutters, extending crosswise of the machine. The ends of these cutters are rotatably supported in bearings 88 attached to supporting frames 90 mounted on the underside of the platform 68. The cutters are driven from their respective engines 30 through suitable drive transmissions 92, which are shown to be belt drives.

Partially surrounding the cutters 86 of the road surfacing means 28 is a housing or enclosure-like structure 94 having a bottom opening through which the cutters 86 are engagable with the road 18. The lower edges 96 of the cutter housings or enclosures 94 are located approximately in or just above a plane tangent to the bottoms of the cutters 86. These housings or enclosures may have limited vertical flexibility or freedom of movement to assure proper surfacing contact of the cutters 86 with the road 18, as explained presently.

At the rear of the surfacing platform 68 is a depth control member 98 located near the longitudinal center line of the platform. This depth control member has an upper vertical post 100 which extends slidably but non-rotatably through a bearing 102 on the platform 68. A pair of parallel side plates 104 are rigidly fixed to the lower end of this post in longitudinal planes of the platform. Rotatably mounted between and protruding below the bottom edges of the side plates 104 are rollers 106 adapted to ride on the road 18.

The depth control member 98 is vertically adjustable relative to the platform 68 by adjusting means 108. The particular adjusting means illustrated comprises a bolt threaded in arm 110 rigidly joined to one of the platform uprights 82 and rotatably connected to the upper end of the depth control post 100.

From this description of the road surfacing mechanism 20, it will be understood that the actuators 42 may be operated to raise and lower the platform 68 and thereby the road surfacing cutters 86, relative to the main load bearing wheels 14 of the machine. The surfacing cutters 86 are driven in rotation by their engines 30. The vertical positions of the cutters relative to the road 18, when the cutters are lowered, is controlled by the vertical position of the depth control member 98 relative to the platform 68.

Traction wheels 22 are mounted on a platform 112 at the rear of the hinged surfacing platform 68. The front end of the wheel platform is hinged at 114 to the rear end of surfacing platform. Traction wheel drive means 24 is a hydraulic motor mounted on the traction wheel platform 112. The traction wheel actuator means 40 comprises a hydraulic actuator 118 including an upper cylinder 120 and a lower plunger 122. The upper end of the cylinder 120 is pivotally attached at 124 to the inclined main frame section 58. The lower end of plunger 122 is pivotally attached at 124 to the hinged traction wheel platform 112. Thus, the actuators 118 may be operated to raise and lower the traction wheels 22 relative to both the main load bearing wheels 14 and the road surfacing cutters 86.

Figure 6:
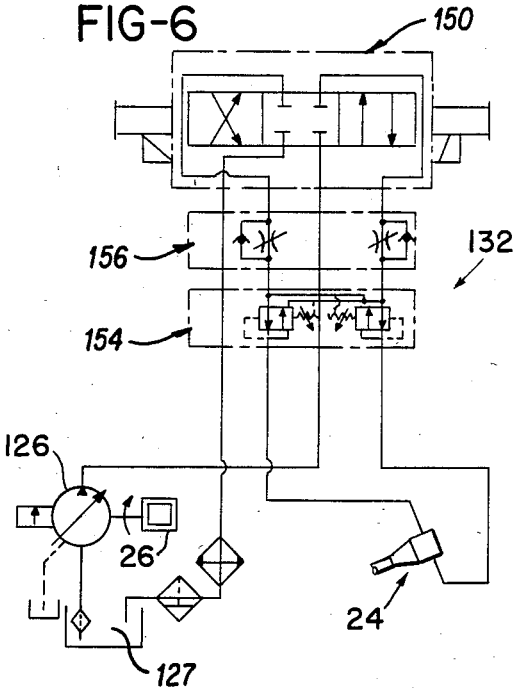
FIG. 6 diagrammatically illustrates the hydraulic traction wheel drive system of the road surfacing machine.
Figure 7:
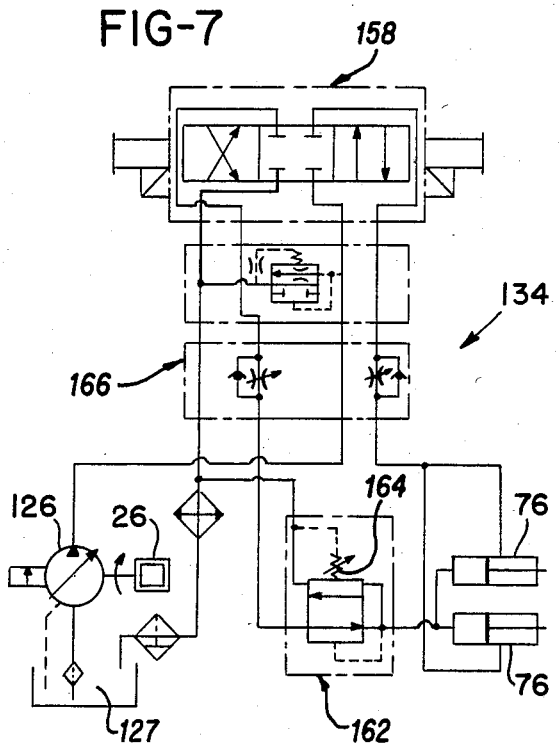
FIG. 7 diagrammatically illustrates the hydraulic system of raising and lowering the road surfacing means or cutters of the road surfacing machine.
Figure 8:
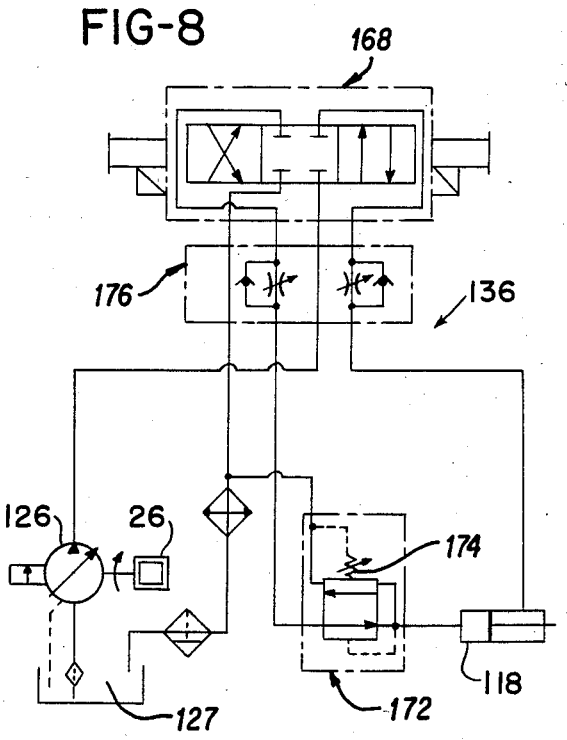
FIG. 8 diagrammatically illustrates the hydraulic system for raising and lowering the traction wheels of the road surfacing machine.

Engine 26 drives a hydraulic pump or pumps 126 (FIGS. 5–8) which supplies hydraulic fluid under pressure to the several hydraulically powered devices on the machine, from a hydraulic fluid reservoir 127 i.e. hydraulic steering mechanism 128, traction wheel drive motor 24, surfacing cutter actuators 76, and tractional wheel actuator 118, as well as any other hydraulic components on the machine, through suitable hydraulic control systems. For the major hydraulic devices listed above, these hydraulic control systems are the hydraulic steering control system 130 of FIG. 5, the hydraulic traction wheel drive control system 132 of FIG. 6, the hydraulic surfacing cutter actuator control system 134 of FIG. 7, and the hydraulic traction wheel actuator control system 136 of FIG. 8. These hydraulic control systems are conventional and their detailed arrangement is not critical to the invention. Accordingly, it is unnecessary to explain the systems in detail.

Figure 5:
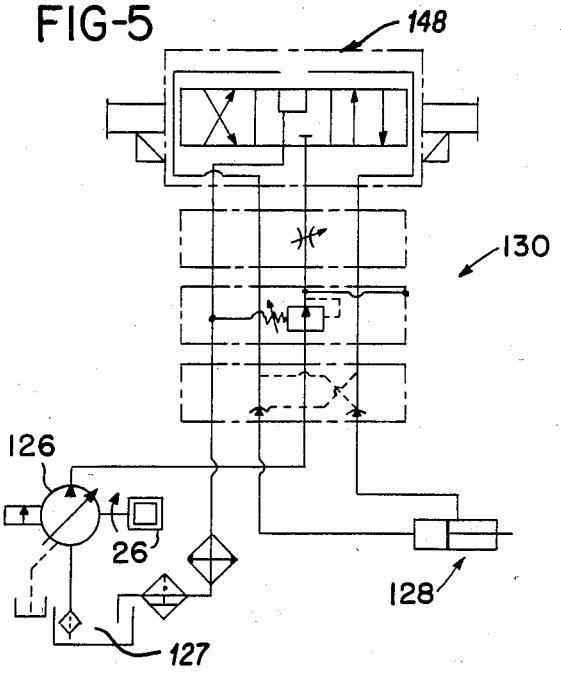
FIG. 5 diagrammatically illustrates the hydraulic steering system of the road surfacing machine.

Suffice it to say that the controls for these hydraulic systems, except the hydraulic steering system 130 of FIG. 5, as well as pressure guages, etc., are mounted on a control panel 138 located at the operator's station 36. The hydraulic steering system 130 includes a steering valve 148 operable by the steering wheel 32 for controlling hydraulic fluid flow from the pump 126 to the hydraulic steering mechanism 128 and from this steering mechanism to the hydraulic fluid reservoir 127 to steer the road surfacing machine.

The traction wheel drive control system 132 includes a control valve 150 for controlling hydraulic fluid flow from the pump 126 to the traction wheel drive motor 24 and from this motor to the reservoir 127 to operate the motor in either direction and thereby propel the surfacing machine forwardly and rearwardly and to stop the motor. The traction wheel drive control valve 150 is operable by a control 152 on the control panel 138. The control system 132 also includes adjustable pressure regulating valves 154 and adjustable flow control valves 156.

The surfacing cutter actuator control system 134 includes a control valve 158 for controlling hydraulic fluid flow from the pump 126 to the cutter actuators 76 and from these actuators to the hydraulic fluid reservoir 127 to raise and lower the surfacing platform 68 and surfacing cutters 86 thereon. The cutter control valve 158 is operable by a control 160 on the control panel 138. The control system 134 also includes an adjustable pressure regulating valve 162 which is adjustable by a control 164 on the control panel 138 to regulate the contact pressure of the cutters 86 with the road or pavement being surfaced, and adjustable flow control valves 166 for controlling the operating speed of the actuators 76.

The traction wheel actuator control system 136 includes a control valve 168 for controlling hydraulic fluid flow from the pump 126 to the traction wheel actuator 118 and from this actuator to the hydraulic fluid reservoir 127 to raise and lower the traction wheels 22. The traction wheel control valve 168 is operable by a control 170 on the control panel 138. The control system 136 also includes an adjustable pressure regulating valve 172 which is adjustable by a control 174 on the control panel 138 to regulate the contact pressure the traction wheels 22 with the road, and adjustable flow control valves 176 for controlling the operating speed of the actuator 118.

As noted earlier, the road surfacing machine has a system 44, including the water tank 46, for spraying water over the surfacing means or cutters 28 for cooling, flushing, and lubricating them. This water system includes a water line 140 containing a water pump 142 for conducting water under pressure from the tank 46 to the cutters and a water return line 144 containing a suction pump 146 for removing water from the cutters and returning the water to the tank. This water system is conventional and no further description is necessary.

It will now be understood that the road surfacing machine is towed from one location to another by connecting its front coupling member 38 to a towing vehicle. The traction wheels 22 and road surfacing means 28 are then elevated by their hydraulic actuators, to clear the road. During road surfacing operation of the machine, the cutter and traction wheel control systems 134, 136 are operated to lower the surfacing cutters 86 and traction wheels 22 into contact with the road or pavement 18 to be surfaced. The cutter and traction wheel pressure regulating valves 162, 172 are adjusted to establish the desired contact pressure of the cutters and traction wheels with the road so as to obtain the desired road surfacing action. In this way, the contact pressure of each may be individually set to achieve the most effective cutting action of the surfacing cutters 86 and minimize or eliminate slipping of the traction wheels 22. In this latter regard, it will be understood that in the event the cutting resistance of the pavement and the speed of the machine are such that the machine is subjected to an upward force tending to reduce the contact pressure of the traction wheels with the road, the traction wheel control system 136 will immediately restore the proper contact pressure of the wheels with the road to minimize or eliminate slipping of the traction wheels. As noted, the weight of the water tank 46 acts on both the surfacing means and traction wheels to increase their contact pressure with the road. The depth control member 98 is set to obtain the desired depth of cut of the cutters 86.

Thus there has been shown and described a novel pavement surfacing machine which fulfills all the objects and advantages sought therefor. Many changes, modifications, variations and other uses and applications of the subject invention will, however, become apparent to those skilled in the art after considering this specification and the accompanying drawings. All such changes, modifications, alterations and other uses and applications which do not depart from the spirit and scope of the invention are deemed to be covered by the invention which is limited only by the claims which follow.

The inventor claims:

1. Apparatus for surfacing a road, comprising:

a vehicle including main wheels, a main frame supported on said main wheels, a cutter support mounted to the main frame for movement toward and away from the road, and a traction wheel support associated with the main frame for movement toward and away from the road independently of the main wheels;

a road surfacing mechanism including cutter means mounted on said cutter support, cutter actuator means connected between said main frame and said cutter support for urging said cutter means downwardly against the road and raising said cutter means from contact with the road, and depth control means for controlling the cutting depth of said cutter means;

a propulsion mechanism including traction wheels mounted on said traction wheel support, traction wheel actuator means connected between said main frame and said traction wheel support for urging said traction wheels downwardly against the road and raising said traction wheels from contact with the road, and means for driving said traction wheels to move the vehicle in a preselected direction of travel when the traction wheels are in contact with the road; and means for controlling said cutter actuator means to selectively raise and lower said cutter means and to urge said cutter means against the road at a first preselected variable pressure, and for independently controlling said traction wheel actuator means to selectively raise and lower said traction wheels and to urge said traction wheels against the road at a second preselected variable pressure.

2. The apparatus of claim 1, wherein:

said surfacing cutter means comprises rotary cutter means, and said surfacing mechanism comprises engine means mounted on said cutter support for driving said cutter means, whereby the weight of said engine means acts downwardly on said cutter means and traction wheels.

3. The apparatus of claim 1, wherein said main frame includes:

a front main frame portion having front and rear ends supported by said main wheels and supporting said surfacing and propulsion mechanisms;

a rear main frame portion supporting said water tank and having front and rear ends, said rear end of the rear main frame being supported by said main wheels;

coupling means pivotally connecting the front end of said rear main frame portion to, and supporting the front end of said rear main frame portion on, the rear end of said front main frame portion; and the apparatus further comprises a water tank mounted on said rear main frame portion for containing water to cool and lubricate said cutter means.

4. The apparatus of claim 1, wherein:

said vehicle includes means for attachment to a towing vehicle for towing said road surfacing machine from one location to another with said cutter means and traction wheels elevated out of contact with the road.

5. The apparatus of claim 1 wherein:

said cutter support is hinged to said main frame to swing substantially vertically relative to said main frame;

said traction wheel support is hinged to said cutter support to swing substantially vertically relative to said cutter support; and said cutter actuator means comprises at least one hydraulic actuator connected between said main frame and said cutter support and said traction wheel actuator means comprises at least one hydraulic actuator connected between said main frame and said traction wheel support.

6. The apparatus of claim 5, wherein:

said control means includes adjustable pressure regulating means for adjusting and maintaining the pressure of hydraulic fluid supplied to both said actuator means.

7. The apparatus of claim 6 wherein:

said pressure regulating means comprise separate pressure regulating means for said cutter actuator means and said traction wheel actuator means.

8. The apparatus of claim 5 wherein:

said cutter support and said traction wheel support each extend lengthwise of said machine and have front and rear ends relative to the direction of travel of the machine along the road to be surfaced;

said cutter support is hinged at its front end to said main frame and said traction wheel supports is situated rearwardly of said cutter support and is hinged at its front end to the rear end of said cutter support; and each of said hydraulic actuators is connected between said main frame and either the rear end of said cutter supports or the rear end of said traction wheel support.

9. The apparatus of claim 8 wherein:

the main frame has a front end and a rear end; and the apparatus further comprises means on said main frame for spraying water onto said cutter means to cool and lubricate said cutter means, including a water tank disposed adjacent to the rear end of the main frame so that its weight acts downwardly on said cutter means and said traction wheels through said cutter actuator means and said traction wheel actuator means, respectively.

10. The apparatus of claim 9 wherein said main frame includes:

a front main frame portion having front and rear ends supported by said main wheels and supporting said surfacing and propulsion mechanisms;

a rear main frame portion supporting said water tank and having front and rear ends, said rear end of the rear main frame portion being supported by said main wheels; and coupling means pivotally connecting the front end of said rear main frame portion to, and supporting the front end of said rear main frame portion on, the rear end of said front main frame portion.

11. The apparatus of claim 8 wherein:

said control means includes adjustable pressure regulating means for adjusting and maintaining the pressure of hydraulic fluid supplied to both said actuator means.

12. The apparatus of claim 11 wherein:

said pressure regulating means comprise separate pressure regulating means for said cutter actuator means and said traction wheel actuator means.

* * * * *

UNITED STATES PATENT AND TRADEMARK OFFICE

CERTIFICATE OF CORRECTION

PATENT NO. : 4,588,231

DATED : May 13, 1986

INVENTOR(S) : Louis E. Silay, James S. Stein, John J. Kunzweiler

It is certified that error appears in the above-identified patent and that said Letters Patent is hereby corrected as shown below:

The phrase "from a hydraulic fluid reservoir 127" is moved from column 6, line 42 to column 6, line 41, immediately before the word "to".

The word "guages" at column 6, line 59 is changed to --gauges--.

The word --of-- is inserted at column 7, line 34 after the word "pressure".

The word "supports" at column 10, line 4 is changed to --support--.

The word "supports" at column 10, line 10 is changed to --support--.

Signed and Sealed this

*Twenty-sixth* Day of *August 1986*

[SEAL]

*Attest:*

DONALD J. QUIGG

*Attesting Officer*

*Commissioner of Patents and Trademarks*